US007533962B2

(12) United States Patent
Masuyama et al.

(10) Patent No.: US 7,533,962 B2
(45) Date of Patent: May 19, 2009

(54) INK JET PRINTING APPARATUS AND INK JET PRINTING METHOD

(75) Inventors: Atsuhiko Masuyama, Yokohama (JP); Jiro Moriyama, Kawasaki (JP); Hidehiko Kanda, Yokohama (JP); Masahiko Umezawa, Kawasaki (JP); Hideaki Takamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/951,911

(22) Filed: Dec. 6, 2007

(65) Prior Publication Data

US 2008/0136851 A1 Jun. 12, 2008

(30) Foreign Application Priority Data

Dec. 11, 2006 (JP) ..... 2006-333362

(51) Int. Cl.
*B41J 2/15* (2006.01)

(52) U.S. Cl. ..... 347/41; 347/14; 347/8

(58) Field of Classification Search ..... 347/8, 347/12, 14, 41
See application file for complete search history.

(56) References Cited

U.S. PATENT DOCUMENTS

| | | | | |
|---|---|---|---|---|
| 5,468,076 | A | 11/1995 | Hirano et al. | |
| 5,896,146 | A | 4/1999 | Murata et al. | 347/42 |
| 6,120,129 | A | 9/2000 | Iwasaki et al. | 347/43 |
| 6,120,141 | A | 9/2000 | Tajika et al. | 347/96 |
| 6,712,443 | B2 | 3/2004 | Kanda et al. | 347/16 |
| 6,899,474 | B2 | 5/2005 | Uchida et al. | |
| 7,044,570 | B2 | 5/2006 | Takahashi et al. | |
| 7,080,892 | B2 | 7/2006 | Moriyama et al. | 347/5 |
| 7,185,964 | B2 | 3/2007 | Kanda et al. | 347/15 |
| 7,261,387 | B2 | 8/2007 | Nishikori et al. | 347/15 |
| 7,284,810 | B2 * | 10/2007 | Igarashi | 347/14 |
| 7,287,830 | B2 | 10/2007 | Ide et al. | 347/43 |
| 7,296,872 | B2 | 11/2007 | Hayashi et al. | 347/19 |
| 7,296,877 | B2 | 11/2007 | Chikuma et al. | 347/41 |
| 7,303,247 | B2 | 12/2007 | Maru et al. | 347/15 |
| 2005/0253880 | A1 | 11/2005 | Nakamura et al. | |
| 2006/0033767 | A1 * | 2/2006 | Weast | 347/14 |
| 2007/0035593 | A1 | 2/2007 | Iwasaki et al. | 347/85 |
| 2007/0273721 | A1 * | 11/2007 | Simons | 347/14 |

FOREIGN PATENT DOCUMENTS

| | | |
|---|---|---|
| JP | 64-75248 | 3/1989 |
| JP | 7-25109 | 1/1995 |

(Continued)

*Primary Examiner*—Lamson D Nguyen
(74) *Attorney, Agent, or Firm*—Fitzpatrick, Cella, Harper & Scinto

(57) ABSTRACT

To provide an ink jet printing apparatus and ink jet printing method capable of printing at high speed and high image quality in accordance with the distance between the head and the paper. In performing a first print mode for printing to a unit region of the print medium by making the print head scan N times (N: positive integer), and executing a second print mode for printing to the unit region of the print medium by making the print head scan M times (M: positive integer, M>N), the distance between the print head and the print medium (distance between the head and the paper) in the first print mode is made shorter than that in the second print mode.

6 Claims, 12 Drawing Sheets

| INTERVAL | SPEED 1 | SPEED 2 | SPEED 3 | SPEED 4 |
|---|---|---|---|---|
| | HIGH SPEED (DRAFT) | HIGH SPEED (FAST) | HIGH SPEED (NORMAL) | LOW SPEED (FINE) |
| PAPER 1 | INTERVAL(i) | INTERVAL(i) | – | INTERVAL(ii) |
| PAPER 2 | – | INTERVAL(i) | – | INTERVAL(ii) |
| PAPER 3 | – | – | – | INTERVAL(ii) |
| · | · | · | · | · |
| · | · | · | · | · |
| · | · | · | · | · |

| NUMBER OF PASSES | SPEED 1 | SPEED 2 | SPEED 3 | SPEED 4 |
|---|---|---|---|---|
| | HIGH SPEED (DRAFT) | HIGH SPEED (FAST) | HIGH SPEED (NORMAL) | LOW SPEED (FINE) |
| PAPER 1 | ONE-PASS (THINNING) | TWO-PASS | – | FOUR-PASS |
| PAPER 2 | – | ONE-PASS | – | FOUR-PASS |
| PAPER 3 | – | – | – | FOUR-PASS |
| · | · | · | · | · |
| · | · | · | · | · |
| · | · | · | · | · |

FOREIGN PATENT DOCUMENTS

| | | |
|---|---|---|
| JP | 2002-292856 | 10/2002 |
| JP | 2004-42346 | 2/2004 |
| JP | 2004-90461 | 3/2004 |
| JP | 2005-280206 | 10/2005 |
| JP | 2006-103278 | 4/2006 |

* cited by examiner

| INTERVAL | SPEED 1 | SPEED 2 | SPEED 3 | SPEED 4 |
|---|---|---|---|---|
| | HIGH SPEED (DRAFT) | HIGH SPEED (FAST) | HIGH SPEED (NORMAL) | LOW SPEED (FINE) |
| PAPER 1 | INTERVAL(i) | INTERVAL(i) | – | INTERVAL(ii) |
| PAPER 2 | – | INTERVAL(i) | – | INTERVAL(ii) |
| PAPER 3 | – | – | – | INTERVAL(ii) |
| . | . | . | . | . |
| . | . | . | . | . |
| . | . | . | . | . |

FIG.10A

| NUMBER OF PASSES | SPEED 1 | SPEED 2 | SPEED 3 | SPEED 4 |
|---|---|---|---|---|
| | HIGH SPEED (DRAFT) | HIGH SPEED (FAST) | HIGH SPEED (NORMAL) | LOW SPEED (FINE) |
| PAPER 1 | ONE-PASS (THINNING) | TWO-PASS | – | FOUR-PASS |
| PAPER 2 | – | ONE-PASS | – | FOUR-PASS |
| PAPER 3 | – | – | – | FOUR-PASS |
| . | . | . | . | . |
| . | . | . | . | . |
| . | . | . | . | . |

FIG.10B

INK JET PRINTING APPARATUS AND INK JET PRINTING METHOD

BACKGROUND OF THE INVENTION

1. Field of the Invention

The present invention relates to an ink jet printing apparatus and ink jet printing method, more particularly, it relates to an ink jet printing apparatus and ink jet printing method capable of printing at high speed and high image quality.

2. Description of the Related Art

Regarding an ink jet printing apparatus, technology is known that adjusts the distance (interval) between a print head and a platen for supporting a print medium (hereinafter referred to as print paper or media). For example, the interval between the print head and the platen (distance between the head and the paper) is adjusted in accordance with the thickness or type of the print medium, in the inventions disclosed in Japanese Patent Laid-Open Nos. 64-075248 (1989), 7-025109, 2002-292856, 2006-103278, 2004-042346, 2004-090461 and 2005-280206.

However, the above patent documents disclose no relationship between the number of scans (number of passes) of the print head and the distance between the head and the paper, although they do disclose a relationship between the type (thickness) of paper and the distance between the head and the paper. Additionally, as a result of diligent research for the relationship between the number of scans (number of passes) of the print head and the distance between the head and the paper, the inventors have newly found that it is effective to change the distance between the head and the paper in accordance with the number of passes.

That is, since the impact position deviation of ink is smaller as the distance between the head and the paper is shorter, it is desirable to reduce the distance between the head and the paper as much as possible. However, as the distance between the head and the paper is shorter, the print head easily comes into contact with the print paper. Thus, the distance between the head and the paper can be reduced only in the case where the print head hardly comes into contact with the print paper. In consideration of this, the relationship between the distance between the head and the paper and the number of passes was considered.

In a multi-pass mode for printing at a relatively large number of passes, the print head successively scans, many times, to a region where printing is performed by the preceding scan (preceding scan print region). In this case, even if a cockling occurs in the preceding scan print region, printing is not completed onto the whole region, and the succeeding scan is performed to the region where the cockling occurs. Then, there is a possibility that the head comes into contact with the cockling paper in the succeeding scan. Accordingly, it is difficult to reduce the distance between the head and the paper in the multi-pass mode.

On the other hand, in a limited-pass mode for printing at a relatively small number of passes, the print head does not scan again or scans, only a small number of times, the region where printing is performed by the preceding scan (preceding scan print region). In this case, printing is completed onto the preceding scan print region when the cockling occurs in the region, and there is a low possibility that the succeeding scan is performed to the region where the cockling occurs. Accordingly, there is a low possibility that the head comes into contact with the cockling paper in the succeeding scan, and the distance between the head and the paper can be reduced in the limited-pass mode.

SUMMARY OF THE INVENTION

As described above, the present invention was made based on a new finding that it is effective to change the distance between the head and the paper in accordance with the number of passes, and it is an object of the present invention to print at high speed and high image quality by setting the distance between the head and the paper appropriate for the number of passes.

In order to achieve the above object, the present invention provides an ink jet printing apparatus for printing by ejecting ink from a print head to a print medium, including print controlling means capable of performing: a first print mode for printing to a unit region of the print medium by making the print head scan N times (N: positive integer) and a second print mode for printing to the unit region of the print medium by making the print head scan M times (M: positive integer, M>N), wherein the distance between the print head and the print medium in printing by the first print mode is shorter than that imprinting by the second print mode.

According to the present invention, the distance between the print head and the print medium can be set appropriately for the number of print passes.

Further features of the present invention will become apparent from the following description of exemplary embodiments (with reference to the attached drawings).

BRIEF DESCRIPTION OF THE DRAWINGS

FIGS. 10A and 10B are schematic views each showing a table of the first embodiment of the present invention;

DESCRIPTION OF THE EMBODIMENTS

Hereinafter, the present invention will be described in detail with reference to the drawings.

First Embodiment

Figure 1:
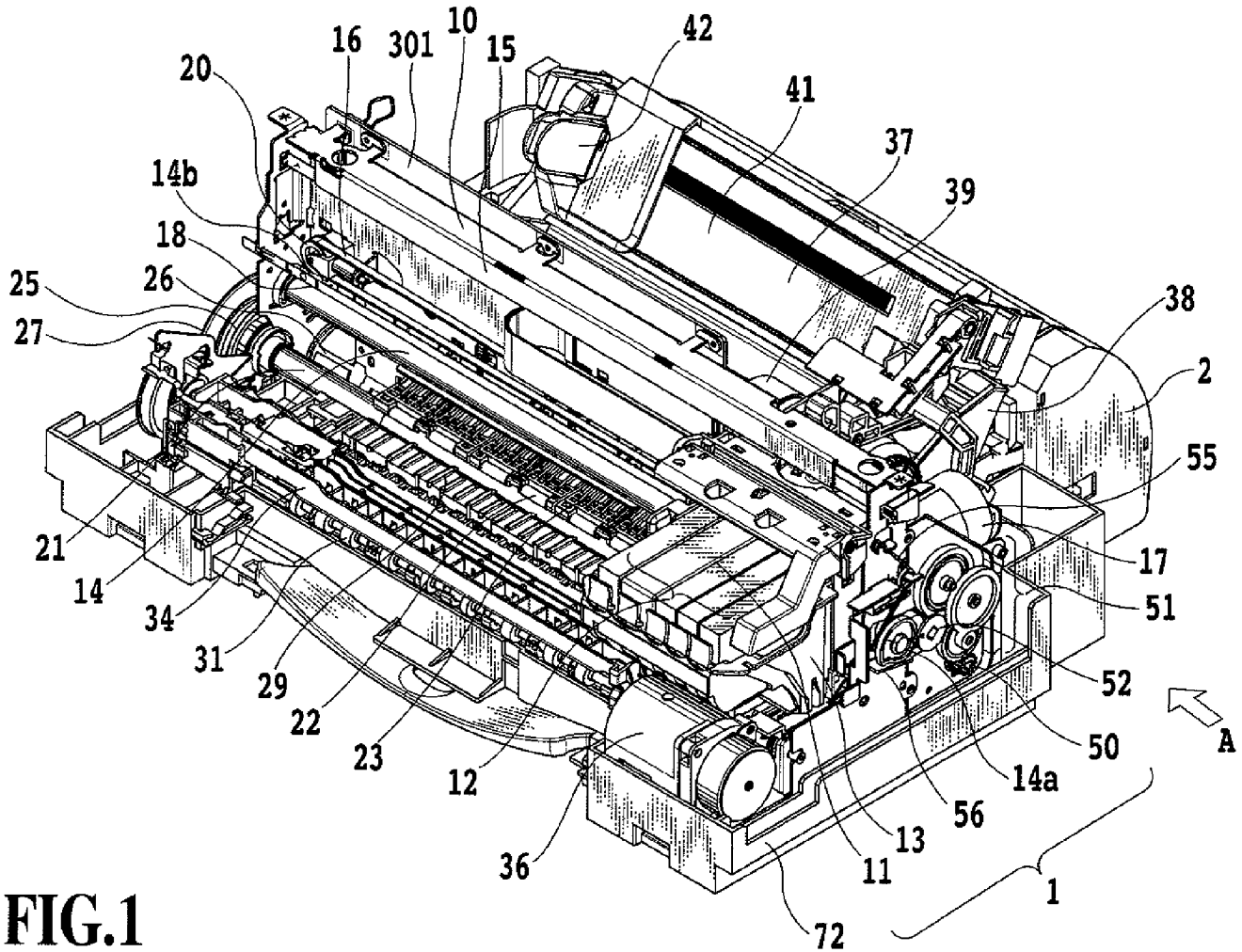
FIG. 1 is a schematic perspective view showing the whole constitution of an ink jet printing apparatus of a first embodiment of the present invention.
Figure 2:
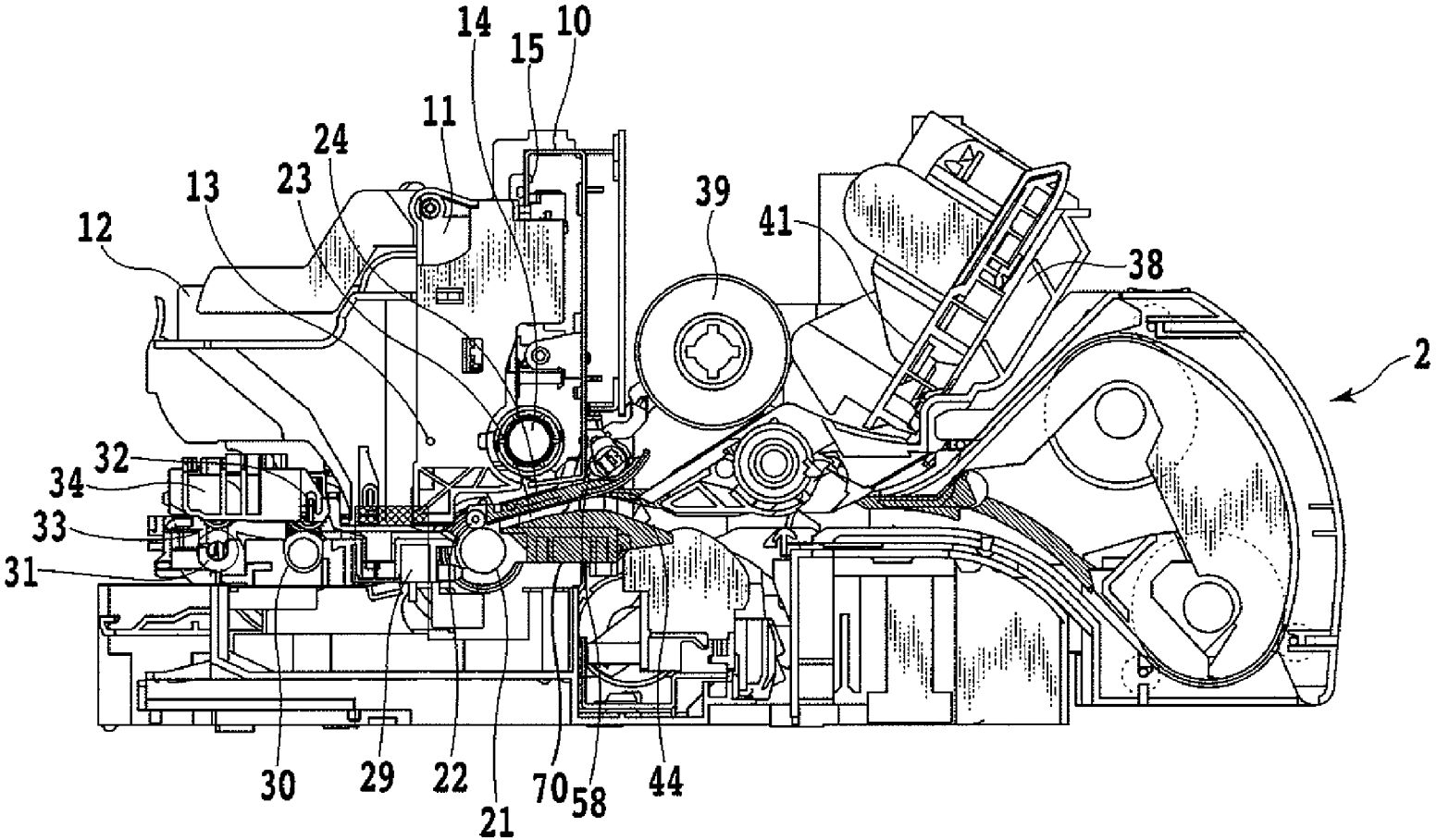
FIG. 2 is a schematic cross sectional view of the printing apparatus in FIG. 1, which is viewed from a direction indicated by an arrow A.
Figure 3:
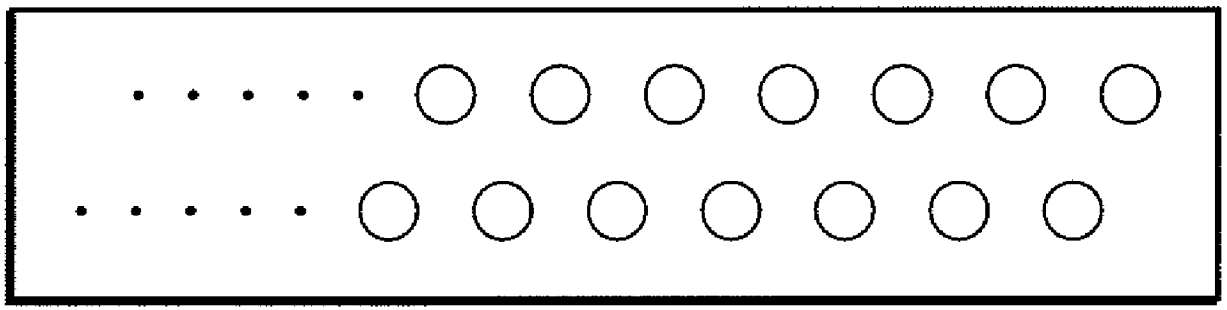
FIG. 3 is a view showing an example of a nozzle arrangement of a print head of the first embodiment of the present invention.

FIG. 1 is a schematic perspective view showing the whole constitution of an ink jet printing apparatus of the first embodiment of the present invention. FIG. 2 is a schematic cross sectional view of the ink jet printing apparatus in FIG. 1, which is viewed from a direction indicated by an arrow A. FIG. 3 is a view showing an example of a nozzle arrangement of a print head mountable on the ink jet printing apparatus shown in FIG. 1.

In these figures, the reference symbol 1 denotes a printing unit body, and the reference symbol 2 denotes an automatic reversing unit. The automatic reversing unit 2 subjects both sides of print paper, onto which printing is to be performed, to desired sides reversing processing, and is attachable/detachable to/from the printing unit body 1. The reference symbol 10 denotes a chassis for supporting the structure of the printing unit body 1.

The reference symbol 11 denotes a print head in which nozzles for ejecting ink are arranged. The nozzles are arranged zigzag in the print head of the embodiment as shown in FIG. 3, and thus printing can be performed at a dot interval not longer than the dot diameter of the ink ejected from the nozzles.

The reference symbol 12 denotes an ink tank for storing ink to be supplied to the print head. The plurality of ink tanks 12 are provided in accordance with the types of color to be used for printing. The print head 11 has a plurality of ink paths so as to be connected to the plurality of ink tanks 12, and the ink path communicates with the nozzle lines provided for each ink color. An ejection actuator for generating energy to be used for ejecting ink is arranged in each nozzle, and the ink is ejected from an ejection port provided at the tip of the nozzle by driving the ejection actuator. As the ejection actuator, an electro-thermo converting element or an electro-machinery converting element such as a piezo-element is employed, the electro-thermo converting element generating heat by energization and generating film boiling in the ink, and the piezo-element generating mechanical energy.

The reference symbol 13 denotes a carriage. The print head 11 and the ink tanks 12 are mounted on the carriage 13, and the carriage scans in a main-scanning direction orthogonal to a print medium conveying direction (sub-scanning direction). The reference symbol 14 denotes a guide shaft which extends in the main-scanning direction to support the carriage, and 14*a* denotes a guide shaft cam shown in FIG. 5. The reference symbol 15 denotes guide rails which extend parallel with the guide shaft 14 to support the carriage 13, and the guide rails 15 are provided as a part of the chassis 10. The reference symbol 16 denotes a carriage belt for driving the carriage 13, and 17 denotes a carriage motor for driving the carriage belt 16 via a pulley. Additionally, the reference symbol 18 denotes a code strip on which codes for detecting the position of the carriage in the main-scanning direction are formed, and 20 denotes an idler pulley for tensing the carriage belt 16 between it and the pulley of the carriage motor 17.

The reference symbol 21 denotes a paper feeding roller for conveying the print paper, and 22 denotes a pinch roller which is pressed against and driven with the paper feeding roller 21. Additionally, the reference symbol 23 denotes a pinch roller holder for holding the pinch roller 22 rotatably, and 24 denotes a pinch roller spring for pressing the pinch roller 22 against the paper feeding roller. Additionally, the reference symbol 25 denotes a paper feeding roller pulley fixed to a shaft of the paper feeding roller, 26 denotes a line-field (LF) motor for driving the paper feeding roller, and 27 denotes a code wheel for detecting the rotation angle of the paper feeding roller.

The reference symbol 29 denotes a platen. The platen 29 supports the print paper opposite to a scan region of the print head 11. The reference symbol 30 denotes a first paper discharging roller for conveying the print paper in cooperation with the paper feeding roller 21, and 31 denotes a second paper discharging roller provided downstream from the first paper discharging roller 30. Additionally, the reference symbol 32 denotes a first spur line in which spur-shaped rollers for holding the print paper opposite to the first paper discharging rollers 30 are arranged, and 33 denotes a second spur line for holding the print paper opposite to the second paper discharging rollers. The first spur line 32 and second spur line 33 are rotatably held by a spur base 34.

The reference symbol 36 denotes a maintenance unit. The maintenance unit 36 is used for processing to prevent clogging from occurring in the nozzle of the print head 11 and keeping ink ejecting performance excellent. Additionally, the maintenance unit 36 is used for processing for guiding ink from an ink tank into the print head 11, the ink tank being newly mounted when replacing the ink tank 12. The maintenance unit 36 is provided so as to be opposite to the print head 11 at a ready position of the carriage 13, and has: a cap connectable to a nozzle formation surface of the print head 11; a wiper for wiping an ink ejection port formation surface of the print head 11; a pump for sucking ink from the nozzle by communicating with an inner space of the cap and applying sucking force; and a transmitting mechanism such as a gear constituting a moving mechanism of the cap and a pump driving mechanism.

The reference symbol 37 denotes an ASF (Automatic Sheet Feeder) for, during printing, separating loaded sheets of print paper one at a time and feeding them, and 38 denotes an ASF base serving as a base for the ASF 37. Additionally, 39 denotes a paper feeding roller which comes into contact with and conveys the loaded print paper, 41 denotes a pressure plate on which the print paper is loaded to be urged toward the paper feeding roller 39, and 42 denotes a side guide provided on the pressure plate 41 and capable of fixing the loaded print paper at the width of the paper.

The reference symbol 50 denotes a lift input gear, 51 denotes a lift reduction speed gear line for transmitting power supplied from the lift input gear 50 while reducing the speed of the power, 52 denotes a lift cam gear directly connected to a lift cam shaft, and 58 denotes the lift cam shaft for lifting the pinch roller holder 23 and the like. The distance (interval) between the print head and the print paper can be changed by using the lift cam gear 52, the lift cam shaft 58 and the like. The details of this will be described below. Additionally, the reference symbol 70 denotes a paper pass guide for guiding the top end of the print paper to a nipping part between the paper feeding roller 21 and the pinch roller 22. The reference symbol 72 denotes a base for supporting the whole printing unit body 1, and 301 denotes a control substrate on which the following controlling part is mounted.

Figure 4:
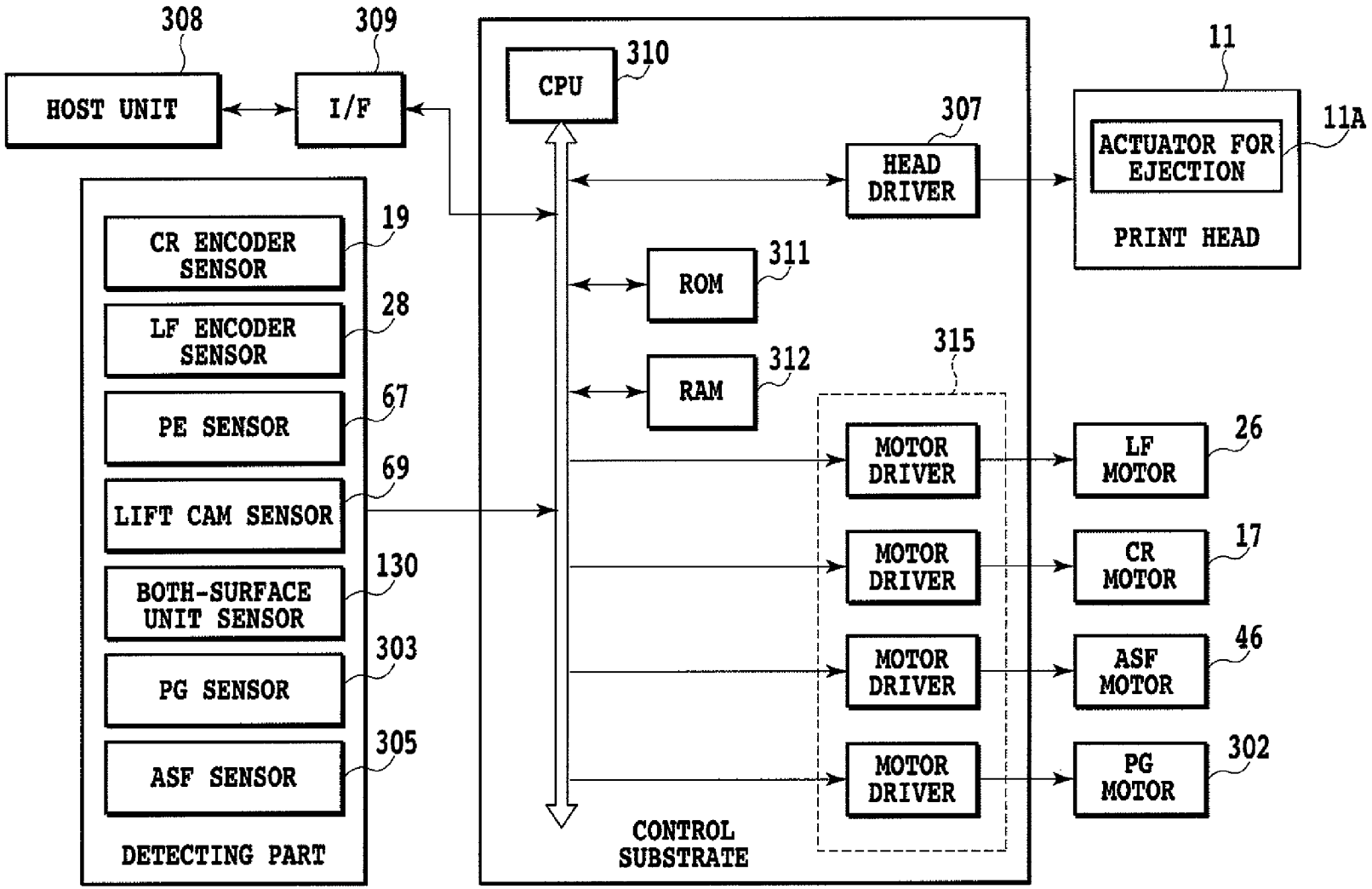
FIG. 4 is a block diagram illustrating a constitutional example of control systems of the printing apparatus of the first embodiment of the present invention.

FIG. 4 is a block diagram illustrating a constitutional example of control systems of the ink jet printing apparatus. In FIG. 4, the reference symbol 19 mounted onto the carriage 13 denotes a carriage (CR) encoder sensor for generating a signal for detecting a position of the carriage by reading the code strip 18. Additionally, the reference symbol 28 denotes a line field (LF) encoder sensor which is attached to the chassis 1 and generates a signal for detecting a carriage position of the print paper by reading the code wheel 27.

The reference symbol 46 denotes an ASF motor for driving the ASF 37, 305 denotes an ASF sensor for detecting the operation of the ASF 37. The reference symbol 67 denotes a paper end (PE) sensor for generating a detection signal of the print paper by detecting the operation of a PE sensor lever (not shown) rotating in accordance with an engagement with the end of the print paper. The reference symbol 69 denotes a lift cam sensor for detecting the operation of the lift cam shaft 58, and 130 denotes a sensor for detecting attachment/detachment of the automatic reversing unit 2.

The reference symbol 302 denotes a PG motor serving as a drive source of the maintenance unit 36, and 303 denotes a PG sensor for detecting the operation of the maintenance unit 36.

The reference symbol 308 denotes a host unit such as a personal computer, the host unit serving as a supply source of image data to the printing apparatus. The reference symbol 309 denotes an interface (I/F) for connecting the host unit 308 to the printing apparatus and transmitting/receiving print data, commands, status or the like. Additionally, the print head 11 has, for example, an element (ejection heater) 11A for generating thermal energy for generating film boiling in ink as energy used for ejecting ink from the nozzles.

The above parts are connected to the controlling part including the following parts mounted on the control substrate 301. The reference symbol 310 denotes a CPU for controlling the whole printing apparatus in the controlling part. For example, the CPU 310 outputs a signal for rotating the lift cam shaft 58 so that the distance between the print head and the print paper is changed. Thus, the guide shaft 14 can be made to go up or down with the rotation of the lift cam shaft 58. The reference symbol 311 denotes a ROM storing a program corresponding to a sequence processing that the CPU 310 executes for control, and other fixed data. The reference symbol 312 denotes a RAM having a region for developing print data, etc., and a region for working. The reference symbol 307 denotes a head driver for driving the ejection heater, etc., of the print head 11. Additionally, the reference symbol 315 denotes a motor driver group for driving each motor.

Next, a summary of the operation of the above constitution will be described. Here, the above-described parts of the printing apparatus of the embodiment are roughly divided into a paper feeding part, a paper conveying part, a printing part, a print head maintenance part and an automatic reversing unit.

When the Ram 312 stores print data transmitted from the host unit 308 via the I/F 309, the CPU 310 outputs a print operation start instruction and starts the print operation. When the print operation starts, paper feeding operation is first performed. The paper feeding operation is performed by the ASF 37 which is the paper feeding part, and the print paper is pulled out one sheet at a time from a plurality of sheets of print paper (not shown) loaded on the pressure plate 41 and fed to the paper conveying part. The print paper conveyed from the paper feeding part is conveyed to the nipping part between the paper feeding roller 21 and the pinch roller 22 which are the paper conveying part.

The printing part mainly includes the print head 11 and the carriage 13 on which the print head is mounted and which scans in a direction orthogonal to a print paper conveying direction. A signal of the head driver 307 is transmitted to the print head 11 via a flexible flat cable 73 while the carriage 13 scans, and thus ink droplets can be ejected in accordance with the print data. Additionally, the code strip 18 tensioned on the chassis 10 is read by the CR encoder sensor 19 mounted on the carriage 13, and thus the ink droplets can be ejected to the print paper at a proper timing. When print for one scan thus ends, only the necessary amount of print paper is conveyed from the paper conveying part. The scan (main-scan) of the carriage 13 or the print head 11 and the carriage (sub-scan) of the print paper are thus alternatively performed, and the print operation is performed throughout the whole print paper.

The maintenance part prevents clogging of the ink ejection nozzle of the print head 11 and removes contamination thereof caused by paper powder, or serves as an ink sucking part during replacement the ink tank 12. During these operations, a cap is connected to (capped over) the ejection port formation surface of the print head 11, the inner pressure is made negative by driving a pump, and thus the ink is sucked. Additionally, in the case where the ink is adhered to the ejection port formation surface after ink suction or a foreign substance such as paper powder is adhered thereto, the wiper is horizontally moved with it in contact with an ejection nozzle surface so that the ink or foreign substance is removed. Further, the print head 11 is protected by performing the capping even in non-print operation.

Next, the characteristic constitution and operation of the embodiment will be described.

Figure 5:
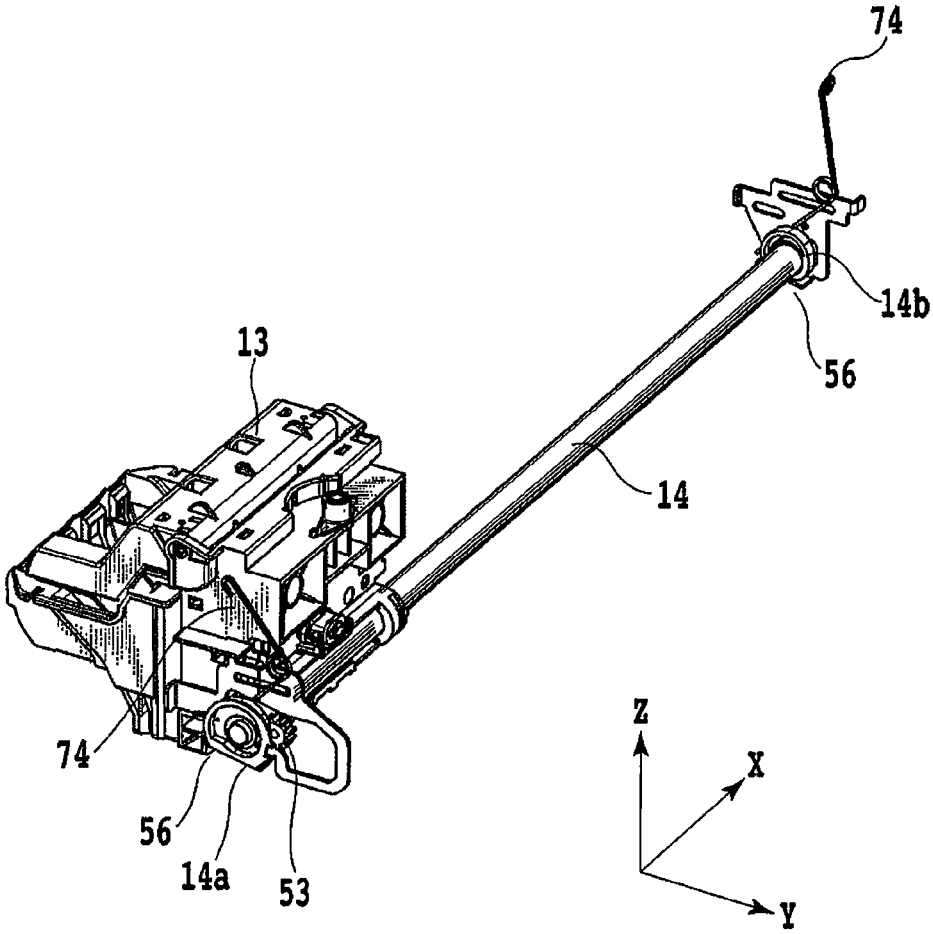
FIG. 5 is a schematic perspective view showing a guide shaft and carriage lifting mechanism of the first embodiment of the present invention.

FIG. 5 is a schematic perspective view showing the guide shaft and a carriage lifting mechanism, which are employed in this embodiment, to adjust the interval (distance) between the print head and the print paper.

In FIG. 5, the reference symbol 14*a* denotes a guide shaft cam attached to the right end side of the guide shaft 14 in the form shown in FIG. 1, and 14*b* denotes a guide shaft cam similarly attached to the left end side thereof. The reference symbol 53 denotes a cam idler gear for connecting the lift cam gear 52 to a gear integrally provided on the guide shaft cam 14*a*. Both ends of the guide shaft 14 are fitted into guide longitudinal holes (not shown) provided in both side plates of the chassis 10, the holes vertically extending, so that the guide shaft 14 is supported by the chassis 10. The guide shaft 14 is movable in a direction indicated by an arrow Z (lifting direction) in FIG. 5, but the movement in directions indicated by arrows X and Y is regulated.

The guide shaft 14 is urged downward (in a direction opposite from the direction by the arrow Z) by a guide shaft spring 74 and is usually hooked on the lower ends of the guide longitudinal holes. Additionally, the guide shaft cams 14*a*, 14*b* come into contact with a guide inclined surface 56 by rotation of the cam idler gear 53, and the guide shaft 14 goes up while rotating itself. Thus, the carriage and the print head, which are supported by the guide shaft 14, also go up.

Figure 6A:
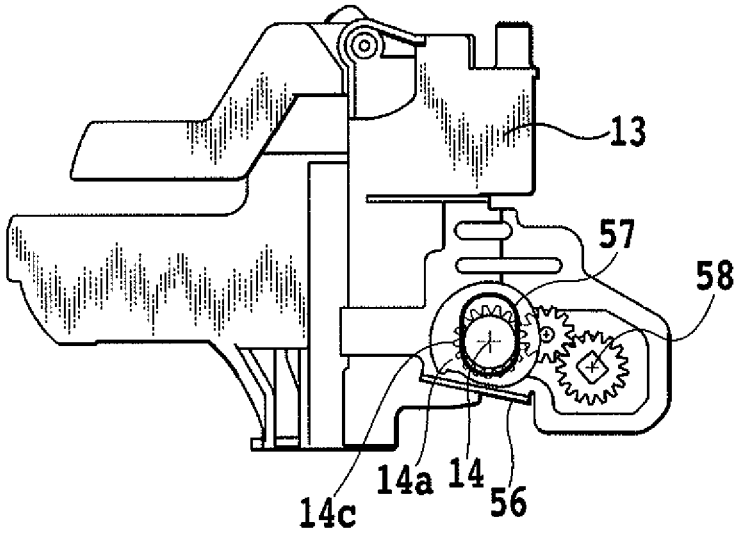
FIGS. 6A and 6B are schematic side views for describing an operation of the carriage lifting mechanism of the first embodiment of the present invention.
Figure 6B:
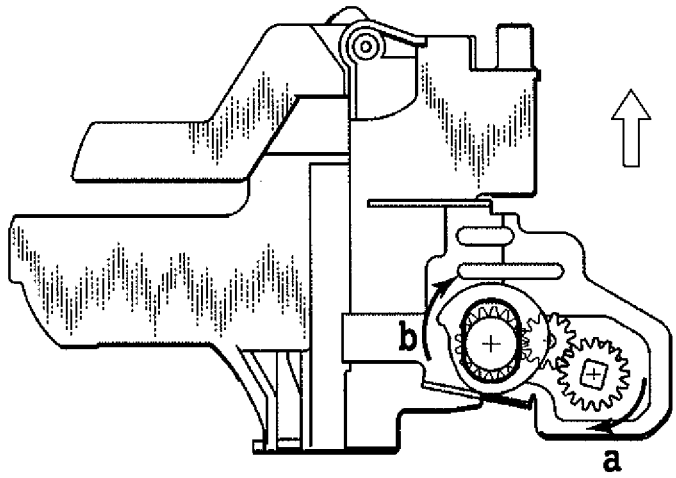

FIGS. 6A and 6B are schematic side views for describing operation of the carriage lifting mechanism. FIG. 6A is a view showing the state where the carriage 13 is located at a standard position, a first position where the print head is relatively proximate to the platen. In this state, the guide shaft 14 is butted against and hooked on the lower ends of the guide longitudinal holes 57 of the chassis, and the guide shaft cam 14*a* does not contact the guide inclined surface 56. On the other hand, FIG. 6B is a view showing the state where the carriage 13 moves to a position slightly higher than the standard position, a second position where the print head is relatively away from the platen.

The carriage 13 is shifted from the first position to the second position. That is, when the carriage 13 is made to go up, the lift cam shaft 58 is rotated. Thus, the lift cam gear 52 fixed to the lift cam shaft 58 rotates, and a guide shaft cam gear 14*c* rotates via the cam idler gear 53 meshed with the lift cam gear 52. When the lift cam shaft 58 then rotates in a direction indicated by an arrow a in FIG. 6B, the guide shaft 14 also rotates in a direction indicated by an arrow b. This rotation makes the guide shaft cams 14*a*, 14*b* come into contact with the fixed guide inclined surface 56. When this rotation is further continued, the cams 14*a*, 14*b* push up the guide shaft 14 in the direction indicated by the arrow Z since, as described above, the movement direction of the guide shaft 14 is regulated only to the vertical direction by the guide longitudinal holes 57 of the chassis 10. Accordingly, the guide shaft 14 moves to the second position. In the case where the guide shaft 14 is shifted from the second position to the first position, the carriage 13 is made to go down, the lift cam shaft 58 may be rotated reversely to the above described direction.

Next, the flow from the user's operation for issuing a print instruction to carry out printing will be described.

Figure 7:
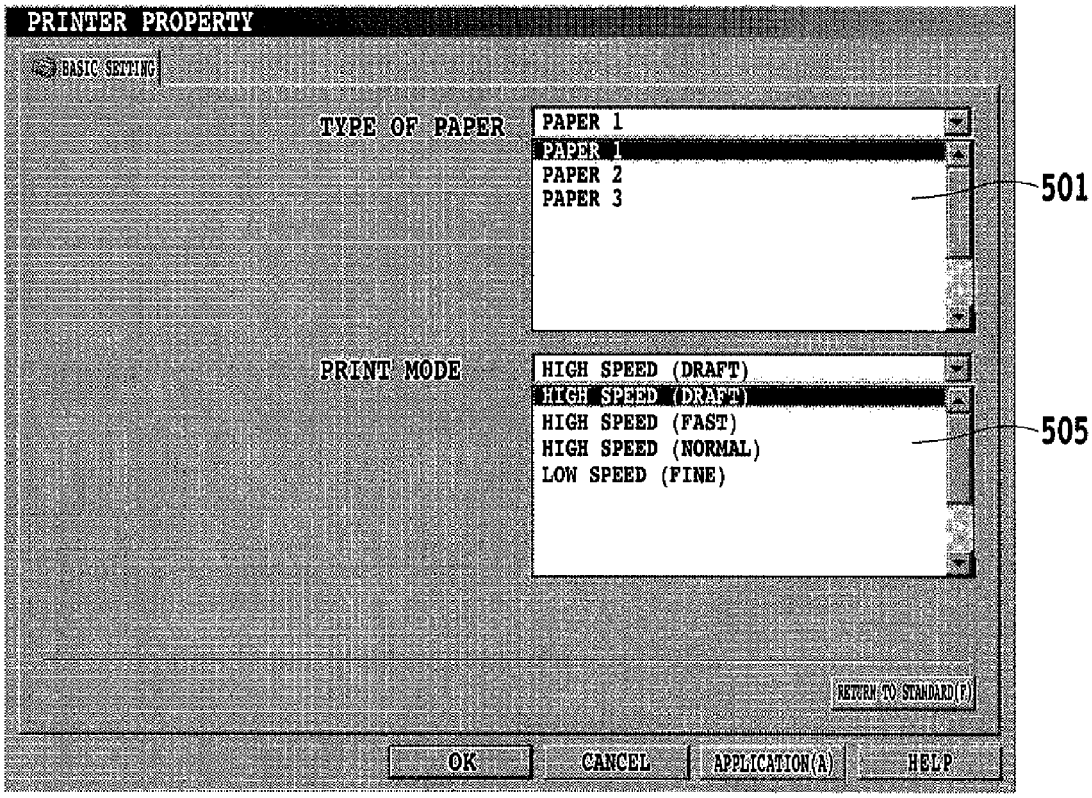
FIG. 7 is a schematic view of a setting screen of the first embodiment of the present invention.

FIG. 7 is a schematic view showing a setting screen shown to the user during printing. The setting screen may be a setting screen of a printer driver stated by issuing a print instruction with use of an application program running on a personal computer type host unit connected to the printing apparatus. In the example of the setting screen, the type of paper 501 and a print mode 505 are selectable. For example, the type of paper 501 is selectable by use of a pull down menu form, and thus a plurality of types of paper 1 to 3 can be selected, these pieces of paper having smoothness and thickness different from each other. Similarly, the print mode 505 is selectable by use of the pull down menu form, and thus a plurality of print modes can be selected, the modes having the print speeds (the number of passes) different from each other.

When the user uses the setting screen to select the type of paper and the print mode and instructs the printing apparatus to start printing, information is set regarding the type of paper and print mode selected by the user, and the setting information and the print data are transmitted to the printing apparatus side via communicating means. Moreover, setting the type of paper and the print mode may be executed not only on the host unit side but on the printing apparatus side in which a display, key and the like are combined.

Figure 12C:
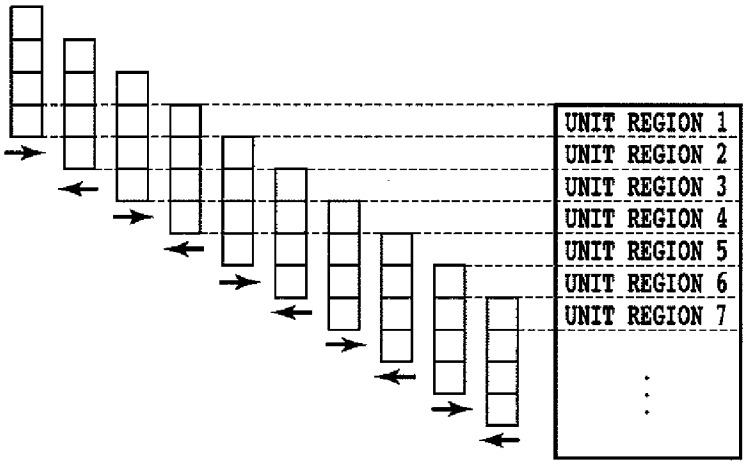
FIGS. 12A to 12C are views for describing print modes performable in the first embodiment, the print modes having the numbers of passes different from each other.
Figure 12A:
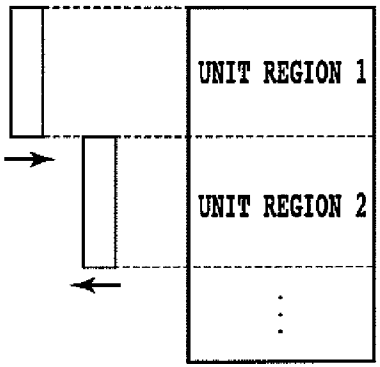
Figure 12B:
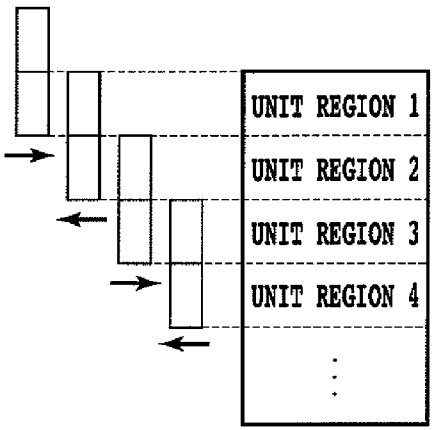

Here, the print modes executable in this embodiment will be described. In this embodiment, as the print modes having the number of passes different from each other, one-pass print mode (see FIG. 12A), two-pass print mode (see FIG. 12B) and four-pass print mode (see FIG. 12C) can be executed. "One-pass print mode" is a print mode that the print head is made to scan once to a unit region corresponding to the width of the print head and printing an image onto the unit region is completed by one scan. "Two-pass print mode" is a print mode that the print head is made to scan twice to a unit region corresponding to half of the width of the print head and printing an image onto the unit region is completed by two scans. "Four-pass print mode" is a print mode that the print head is made to scan four times to a unit region corresponding to a fourth of the width of the print head and printing an image onto the unit region is completed by four scans.

The three print modes having the number of passes different from each other can be thus executed in the printing apparatus of the embodiment. However, the number of executable print modes is not limited to three, and may be two or four or more. That is, modes ("N-pass mode" or "First print mode", and "M-pass mode" or "Second print mode") may be executable: that printing is performed by making the print head scan to the unit region of the print medium N (N: positive integer) times; and that printing is performed by making the print head scan to the unit region of the print medium M (M>N, M: positive integer) times. As a suitable example, N=1, and M is an integer of two or more.

Figure 8:
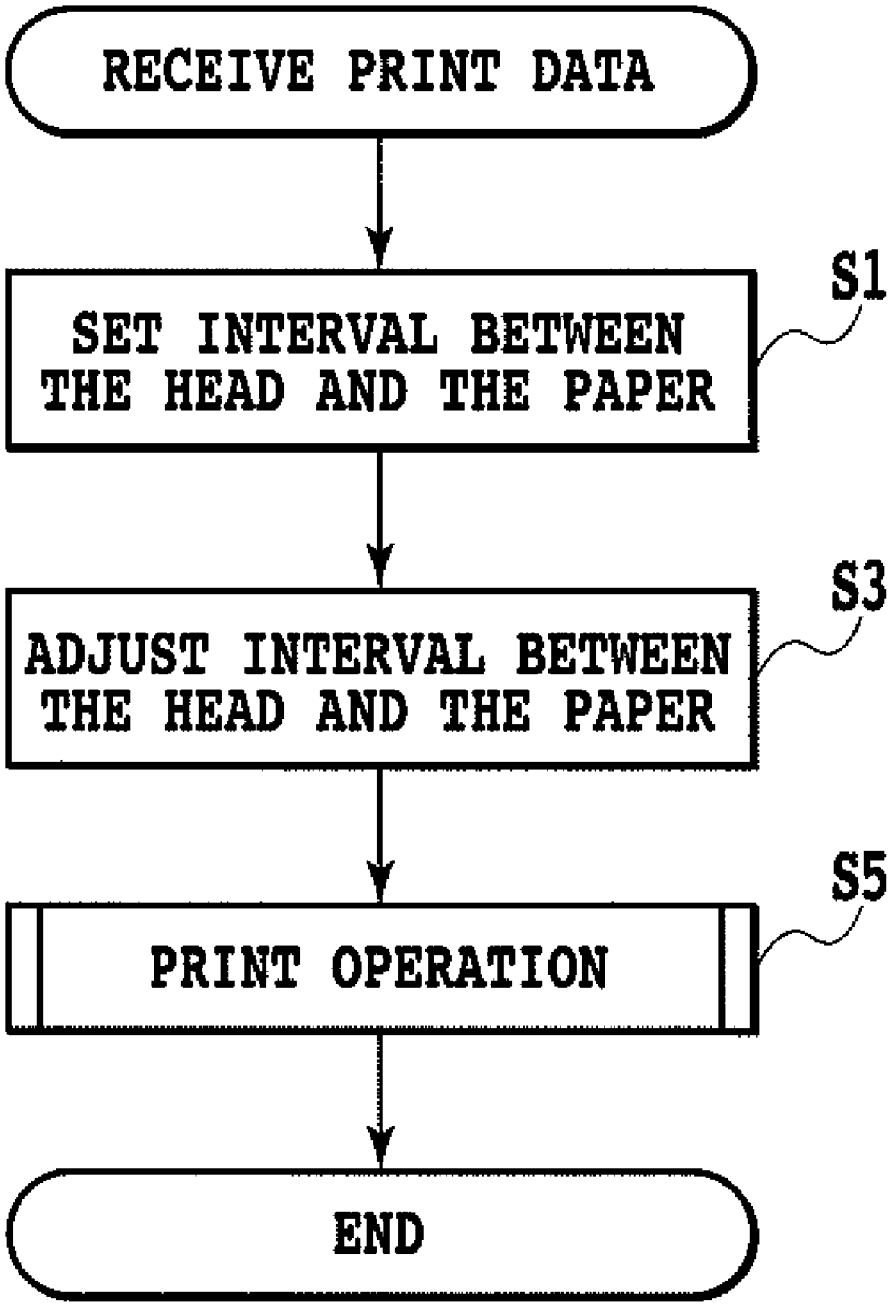
FIG. 8 is a flowchart illustrating a sequence processing of the first embodiment of the present invention.

FIG. 8 is a flowchart illustrating an example of a sequence procedure that the printing apparatus executes in accordance with received image data. First, the printing apparatus receives setting information of the print paper (paper information), setting information of the print mode (print mode information) and image data and sets the distance between the print head and the platen (hereinafter, referred to as a distance between the head and the paper) based on these setting information and data (Step S1). For example, a table (see FIG. 10) is stored in the ROM 311 in advance, the table correlating the setting information (paper information and print mode information) with information of the distance between the head and the paper, and the information of the distance between the head and the paper corresponding to the setting information received as described above is read from the ROM 311. The information of the distance between the head and the paper thus read is written into the RAM 312 so that the distance between the head and the paper is set.

Figure 9:
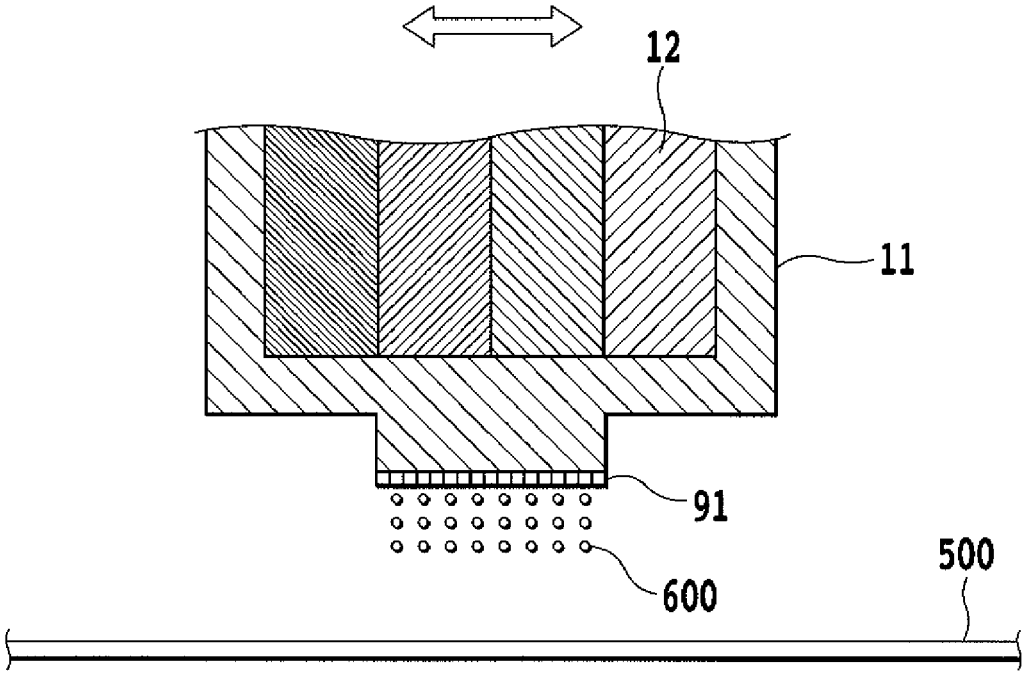
FIG. 9 is a view showing a positional relationship between the print head of the ink jet printing apparatus of the first embodiment of the present invention and print paper.

FIG. 9 is a view showing a positional relationship between the print head 11 of the printing apparatus and the print paper. The distance between an ejection port formation surface 91 and paper 500 corresponds to the distance between the head and the paper, and an ink droplet 600 flies in the air between the head and the paper.

FIGS. 10A and 10B show an example of the table to be seen in Step S1 in FIG. 8. FIG. 10A shows the table for setting an interval between the print head and the platen based on the relationship between the type of paper and the print mode (print speed). Additionally, FIG. 10B shows the table for setting the number of passes based on the relationship between the type of paper and the print mode (print speed).

As an appropriate interval between the print head and the platen according to the relationship between the type of paper and the print mode, information of an interval (i) corresponding to the first position or interval (ii) corresponding to the second position is selected with use of the table shown in FIG. 10A. Additionally, information of the appropriate number of passes of the print head according to the relationship between the type of paper and the print mode is selected with use of the table shown in FIG. 10(*b*). Moreover, in FIGS. 10A and 10B, a part, where a hyphen "-" is inserted, indicates a non-selectable combination. For example, the combination of "paper 2" and "high speed 1" cannot be selected.

In Step S3 in FIG. 8, the interval between the print head and the platen is adjusted (changed) based on the interval information selected in Step S1. That is, when the interval information is different from the currently set interval information, the carriage is controlled so as to go up from the first position to the second position, or go down from the second position to the first position.

Then, after the distance between the print head and the platen is thus adjusted (in Step S3), printing is executed at the set number of passes based on the print data received as described above (Step S5). For example, in the case where "paper 2" is set as the type of paper and "speed 2" is set as the print mode, the one-pass printing is executed at the interval (i) according to the first position. On the other hand, in the case where "paper 2" is set as the type of paper and "speed 4" is set as the print mode, the four-pass printing is executed at the interval (ii) according to the second position. As described above, in limited-pass mode (e.g. one-pass mode), printing is executed at the distance between the head and the paper set shorter than that of the multi-pass mode (e.g. four-pass mode).

Moreover, in this embodiment, the two types of intervals can be set, and the interval (i) corresponding to the first position and the interval (ii) corresponding to the second position can be set to about 0.5 mm and about 1.5 mm respectively. However, in the present invention, the value of the interval is not limited to the above values. That is, an appropriate value can be set in accordance with the kind, size of print paper to be used, properties of ink, properties of a printing apparatus, and the like. Additionally, intervals of three or more, an interval (iii), interval (iv) in addition to the intervals (i) and (ii), may be set, and the number of choices of print mode is increased in accordance with the type of print paper. In this case, as the number of passes is smaller, it is preferable to determine a relationship between the number of passes and the distance between the head and the paper so as to make the distance between the head and the paper shorter.

In this embodiment, "paper 1" is a paper on which a relatively large cockling easily occurs. As a representative example of "paper 1," normal paper and reproduced paper can be cited. When the multi-pass mode (e.g. four-pass mode) printing is executed to "paper 1" such as normal paper or recycled paper, the distance between the head and the paper is set to the interval (ii) corresponding to the second position. The reason will be described below. That is, in the multi-pass mode for printing at a relatively large number of passes, the print head successively scans, many times, a region where printing is performed by the preceding scan (preceding scan print region) In this case, even if a cockling occurs in the preceding scan print region, printing is not completed onto the whole region, and there is a high possibility that the succeeding scan is performed to the region where the cockling occurs. Then, in the succeeding scan, the head comes into contact with the paper on which the cockling occurs. Accordingly, it is difficult to reduce the distance between the head and the paper in the multi-pass mode.

On the other hand, when the limited-pass mode (e.g. one-pass mode or two-pass mode) printing is executed to "paper 1" such as normal paper or recycled paper, the distance between the head and the paper is set to the interval (i) corresponding to the first position. The reason will be described below. That is, in the limited-pass mode for printing at a relatively small number of passes, the print head does not scan again or scans, only a small number of times, the region where printing is performed by the preceding scan (preceding scan print region). In this case, printing is completed onto the preceding scan print region when the cockling occurs in the region, and there is a low possibility that a successive scan is performed to the region where the cockling occurs. Accordingly, there is a low possibility that the head comes into contact with the cockled paper in the successive scan. Additionally, the distance between the head and the paper can be reduced in the limited-pass mode.

As described above, regarding "paper 1," the distance between the head and the paper in the N-pass mode corresponding to the limited-pass mode is set shorter than that in the M-pass mode (M>N) corresponding to the multi-pass mode.

Next, as a representative example of "paper 2" having high smoothness and high hardness, glossy paper can be cited. In the case of "paper 2" having high smoothness, the distance between the head and the paper can be basically reduced. Therefore, when the limited-pass mode (e.g. one-pass mode) printing is executed, the distance between the head and the paper is set to the interval (i) corresponding to the first position. On the other hand, in the case of the multi-pass mode (e.g. four-pass mode) needing a long time for printing, there is a possibility of causing trouble that the head comes into contact with curled paper during printing. Accordingly, in this embodiment, the distance between the head and the paper is set to the interval (ii) corresponding to the second position in the multi-pass mode so that such trouble is avoided. As described above, similar to "paper 1," regarding "paper 2," the distance between the head and the paper in the N-pass mode corresponding to the limited-pass mode is set shorter than that in the M-pass mode (M>N) corresponding to the multi-pass mode.

Finally, "paper 3" is a type of paper such as so-called Japanese paper or canvas paper, the paper having unevenness in thickness, and having low smoothness and low hardness. Accordingly, in the case of "paper 3," since there is a possibility that the head rubs against the paper when the distance between the head and the paper is reduced by selecting the limited-pass mode (high speed mode), the high speed print mode cannot be selected and the multi-pass printing (four-pass printing) is performed at the second position.

As described above, the feature of the embodiment is that the distance between the head and the paper in the N-pass mode corresponding to the limited-pass mode is set shorter than that in the M-pass mode (M>N) corresponding to the multi-pass mode. Thus, in the limited-pass mode that impact position deviation easily occurs by nature, the impact position deviation can be greatly reduced.

Second Embodiment

The mechanical constitution and control system of the second embodiment of the present invention is basically similar to those of the first embodiment, and therefore description will be omitted.

Figure 11A:
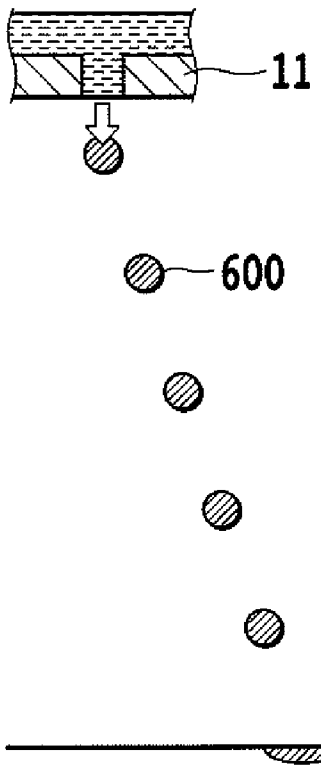
FIGS. 11A to 11C are views each showing a dropping track of an ink droplet between the head and the paper in a second embodiment.
Figure 11B:
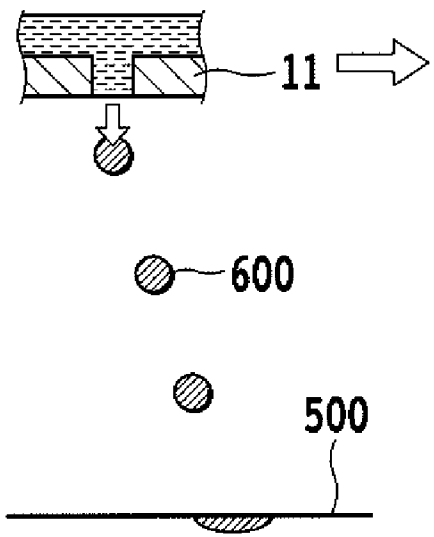
Figure 11C:
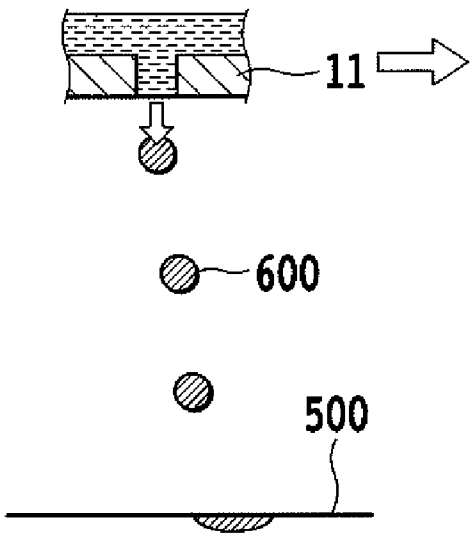

FIG. 11A is a conceptual view showing a dropping track of the ink droplet 600 in the case where the distance between the print head and the paper is long like the second position of the first embodiment. Here, in order that a streak hardly occurs even if the ink droplet deviates, the distance between the head and the paper is reduced in the first embodiment as shown in FIG. 11B. However, in the second embodiment, as shown in FIG. 11C, the scan speed of the carriage is reduced in addition to reducing the distance between the head and the paper. That is, the moving speed of the carriage in the limited-pass mode, in which the distance between the head and the paper is short, is made lower than that of the multi-pass mode. Thus, the deviation of the ink droplet can be controlled, and the impact position deviation can be reduced.

As described above, in this embodiment, the impact position deviation of a dot can be further reduced by reduction of the moving speed of the carriage and the control system of the first embodiment.

Third Embodiment

In the first embodiment, regarding "paper 2," the distance between the head and the paper is set to the interval (i) in the few-pass mode, and is set to the interval (ii) in the multi-pass mode. However, the cockling is hardly caused to "paper 2" compared with "paper 1," and, even if the distance between the head and the paper is set to the interval (i) in the multi-pass mode, the print head does not come into contact with the paper depending on the ejection amount of ink and the structure of the paper 2.

Thereupon, in a third embodiment, the distance between the head and the paper is set to the interval (i) not only in the few-pass mode but also in the multi-pass mode, in the case of printing onto "paper 2." That is, regarding the paper 2 such as glossy paper, the distance between the head and the paper is kept short and fixed to the utmost regardless of the number of passes. The multi-pass printing of the interval (i) can be thus executed to the print medium such as glossy paper having high hardness, and therefore printing can be executed at high impact precision and small density unevenness.

As described above, in the third embodiment, the distance between the head and the paper is changed only for the paper (normal paper) that changing the distance is of great necessity, and the distance is not changed for the paper (glossy paper) that changing the distance is slightly required. More concretely, when printing is performed for a first paper medium (paper 1: normal paper, etc.), the distance between the head and the paper of the limited-pass mode (N-pass mode, first print mode) is made shorter than that of the multi-pass mode (M-pass mode, second print mode). On the other hand, when printing is performed to a second paper medium (paper 2: glossy paper, mat paper, film, etc.), the distance between the head and the paper of the limited-pass mode (K-pass mode, third print mode) is made equal to that of the multi-pass mode (L-pass mode, fourth print mode). Here, K=1, and L=4. However, the combination of K and L is not limited to the above-described combination as long as K and L are positive integers and L>K. Additionally, K and L may be the same as or different from N and M respectively. For example, in the case where N=1 and M=4, the following combinations of K and L may be employed: K=2 and L=4, K=4 and L=8, K=6 and L=16 and the like. Moreover, K-pass mode is a mode for printing to a unit region of the paper 2 by making the print head scan K times, and L-pass mode is a mode for printing to the unit region of the paper 2 by making the print head L times.

The Other

In the above-described embodiments, the distance between the print paper and the platen is changed in accordance with the print paper and printing speed (number of passes) selected by the user. However, in the present invention, the distance between the print paper and the platen may be changed without consideration of the type of paper, and only with consideration of the number of passes. Additionally, as another embodiment, the distance between the print paper and the platen may be changed with consideration of the size of paper in addition to the type of paper and the number of passes.

Additionally, regarding the above embodiments, the mechanism is described that the distance is adjusted by making the guide shaft or carriage go up or down. However, a mechanism applicable to the present invention is not limited to this mechanism. Another mechanism is applicable as long as the relative distance between the print paper and the platen can be changed. Additionally, although the interval is adjusted, changed, at two stages in this embodiment, it may be adjusted at three or more stages.

Further, interval information is selected with reference to the table in the above embodiments, but may be directly input from the host unit or printing apparatus.

Furthermore, as the type of printing apparatus, a so-called line printer is applicable, the line printer being formed by arranging printing elements in the range corresponding to the whole width of a print medium, in addition to a so-called serial type printer described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-333362, filed Dec. 11, 2006, which is hereby incorporated by reference herein in its entirety.

What is claimed is:

1. An ink jet printing apparatus for printing by ejecting ink from a print head to a print medium, comprising:

print controlling means capable of performing a first print mode for printing to a unit region of the print medium by making the print head scan N times (N: positive integer) and a second print mode for printing to the unit region of the print medium by making the print head scan M times (M: positive integer, M>N), wherein the distance between the print head and the print medium in executing the first print mode is shorter than that in executing the second print mode.

2. The ink jet printing apparatus according to claim 1, wherein N is one, and M is an integer of two or more.

3. The ink jet printing apparatus according to claim 1, wherein the scan speed of the print head of the first print mode is lower than that of the second print mode.

4. An ink jet printing apparatus for printing by ejecting ink from a print head to a print medium, comprising:

print controlling means capable of performing a first print mode for printing to a unit region of a first print medium by making the print head scan N times (N: positive integer), a second print mode for printing to the unit region of the first print medium by making the print head scan M times (M: positive integer, M>N), a third print mode for printing to a unit region of a second print medium by making the print head scan K times (K: positive integer) and a fourth print mode for printing to the unit region of the second print medium by making the print head scan L times (L: positive integer, L>K), wherein the distance between the print head and the print medium in executing the first print mode is shorter than that in executing the second print mode, and the distance between the print head and the print medium in executing the third print mode is equal to that in executing the fourth print mode.

5. The ink jet printing apparatus according to claim 4, wherein the first print medium is normal paper and the second print medium is glossy paper.

6. An ink jet printing method for printing by ejecting ink from a print head to a print medium, comprising the steps of:

setting one print mode selected from a plurality of print modes including a first print mode for printing to a unit region of the print medium by making the print head scan N times (N: positive integer) and a second print mode for printing to the unit region of the print medium by making the print head scan M times (M: positive integer, M>N); and performing the print mode set in said setting step, wherein the distance between the print head and the print medium in performing the first print mode is shorter than that in performing the second print mode.

* * * * *